US007665270B1

(12) United States Patent
Moffly

(10) Patent No.: US 7,665,270 B1
(45) Date of Patent: Feb. 23, 2010

(54) LATTICE STRUCTURE ASSEMBLY HAVING MEMBERS WITH OVERLAPPING END SECTIONS CONNECTED BY CONNECTION RODS

(75) Inventor: John Moffly, San Francisco, CA (US)

(73) Assignee: LatticeStix, Inc., San Francisco, CA (US)

( * ) Notice: Subject to any disclaimer, the term of this patent is extended or adjusted under 35 U.S.C. 154(b) by 83 days.

(21) Appl. No.: 11/838,190

(22) Filed: Aug. 13, 2007

Related U.S. Application Data

(60) Provisional application No. 60/954,302, filed on Aug. 6, 2007.

(51) Int. Cl.
*E04C 2/42* (2006.01)
*B65D 19/38* (2006.01)
*F16B 13/00* (2006.01)

(52) U.S. Cl. ..... 52/668; 52/DIG. 2; 108/57.19; 403/231; 403/294; 403/393

(58) Field of Classification Search ..... 52/DIG. 2, 52/668, 666, 664, 663, 633; 108/57.19, 56.1, 108/57.17, 57.2; 403/231, 292, 294, 295, 403/364, 393
See application file for complete search history.

(56) References Cited

U.S. PATENT DOCUMENTS

| | | | | | |
|---|---|---|---|---|---|
| 208,420 | A | * | 9/1878 | Ostrum | 52/668 |
| 1,140,657 | A | * | 5/1915 | Benjamins | 52/667 |
| 2,384,303 | A | * | 9/1945 | Heath | 52/668 |
| 2,672,658 | A | | 3/1954 | Pedersen | |
| 2,877,510 | A | * | 3/1959 | Bruemmer | 52/509 |
| 3,016,222 | A | * | 1/1962 | Arthur | 108/56.1 |
| 3,469,542 | A | * | 9/1969 | Ahlenius | 108/56.1 |
| 3,589,439 | A | * | 6/1971 | Huggins et al. | 165/134.1 |
| 3,883,258 | A | | 5/1975 | Hewson | |
| 3,913,154 | A | * | 10/1975 | Sweeney | 5/186.1 |
| 3,927,950 | A | | 12/1975 | Herrman et al. | |
| 4,145,858 | A | * | 3/1979 | Dovman | 52/456 |
| 4,333,287 | A | | 6/1982 | Lewis | |
| 4,371,035 | A | * | 2/1983 | Soligno | 165/162 |

(Continued)

*Primary Examiner*—Gay Ann Spahn
(74) *Attorney, Agent, or Firm*—Mahamedi Paradice Kreisman LLP

(57) ABSTRACT

A lattice structure includes a plurality of members and a plurality of connection rods. The plurality of members may be individually oriented to form the lattice structure. Each of the plurality of members may include at least one of (i) an end section having a sidewall and a platform that define an end gap, or (ii) a mid-section having two sidewalls and a platform that define a mid-gap. Each member of the lattice structure may be connected to at least one other member, so that the lattice structure includes a plurality of connections between individual members in the plurality of members. Furthermore, each of at least some of the plurality of connections is formed by one of (i) an end section of a first member of that connection overlapping an end section of a second member of that connection; or (ii) an end section of the first member of that connection overlapping with a mid-section of the second member of that connection. The connections may further be formed by at least one connection rod that extends (i) lengthwise at least partially into the first member of that connection, and (ii) at least partially into the second member of that connection. This results in the connection rod maintaining the end section of the first member in overlapping the end section or mid-section of the second member.

8 Claims, 7 Drawing Sheets

U.S. PATENT DOCUMENTS 4,715,503 A 12/1987 Johnson
4,821,481 A * 4/1989 Woodman ..... 52/664
4,841,879 A * 6/1989 Ferguson ..... 108/57.19
4,894,974 A * 1/1990 Mayhew et al. ..... 52/783.1
4,907,389 A 3/1990 Pettit
5,018,332 A * 5/1991 Ying-Kit ..... 52/666
5,048,251 A * 9/1991 Turner ..... 52/456
5,157,892 A * 10/1992 Ryther ..... 52/793.11
5,184,558 A * 2/1993 Wozniacki ..... 108/51.3
5,425,314 A * 6/1995 MacFarland ..... 108/51.3
5,461,988 A * 10/1995 Cummings et al. ..... 108/51.3
5,487,345 A * 1/1996 Winebarger et al. ..... 108/51.3
5,528,870 A * 6/1996 Zamerovsky ..... 52/263
5,685,234 A * 11/1997 Grigsby et al. ..... 108/51.3
5,791,108 A * 8/1998 Conti ..... 52/308
5,823,726 A * 10/1998 Woods et al. ..... 410/155
5,832,689 A * 11/1998 Curll ..... 52/656.9
D402,381 S * 12/1998 Gruda et al. ..... D25/100
6,045,290 A * 4/2000 Nocievski ..... 403/231
6,061,988 A * 5/2000 Parker ..... 52/604
6,254,301 B1 * 7/2001 Hatch ..... 403/298
6,926,613 B1 * 8/2005 Binning ..... 473/31
6,990,777 B2 * 1/2006 Poliacek et al. ..... 52/384
2001/0000557 A1 * 5/2001 Cantley ..... 52/666
2004/0154252 A1 * 8/2004 Sypeck et al. ..... 52/506.01
2005/0011152 A1 * 1/2005 O'Grady et al. ..... 52/364
2005/0198802 A1 * 9/2005 McPherson ..... 29/430
2006/0037281 A1 * 2/2006 Yong et al. ..... 52/784.14
2007/0256614 A1 * 11/2007 Chen ..... 108/153.1
2008/0155933 A1 * 7/2008 Shepherd ..... 52/668

* cited by examiner

LATTICE STRUCTURE ASSEMBLY HAVING MEMBERS WITH OVERLAPPING END SECTIONS CONNECTED BY CONNECTION RODS

RELATED APPLICATIONS

This application claims benefit of priority to Provisional U.S. Patent Application No. 60/954,302 filed Aug. 6, 2007, entitled "Enhanced Lattice Structure Assembly and Components for Making Same"; the aforementioned priority application being hereby incorporated by reference in its entirety.

BACKGROUND OF THE INVENTION

Traditional lattice is used for a wide variety of garden applications including fencing, climbing plant support, fences, trellis, pergolas, and gates. Decorative lattice is also used in furniture, screens, and other architectural decoration.

Lattice pattern may be plain, e.g. a regular system of squares or diamonds, or it may embed pattern.

Most traditional lattice is made from wood, however other materials include ceramic tiles, concrete, steel, and other building materials.

Wood lattice is built using several methods. Traditional lattice, especially patterned lattice, was built from many separate components connected with a hand cut wood joint, typically a mortise and tenon or a bird's mouth joint. A faster method is to dado the pieces, fit together, and then glue or nail the joints to keep them secure. Simple lattice can be built by laying criss-cross pieces of wood and then gluing or stapling them together. While the first method is undeniably the strongest method with the best aesthetic results, it also very time consuming and expensive. The latter two methods are cheaper but require specialized tools, and the result lacks structural integrity and is often less aesthetically pleasing.

DETAILED DESCRIPTION

Figure 1A:
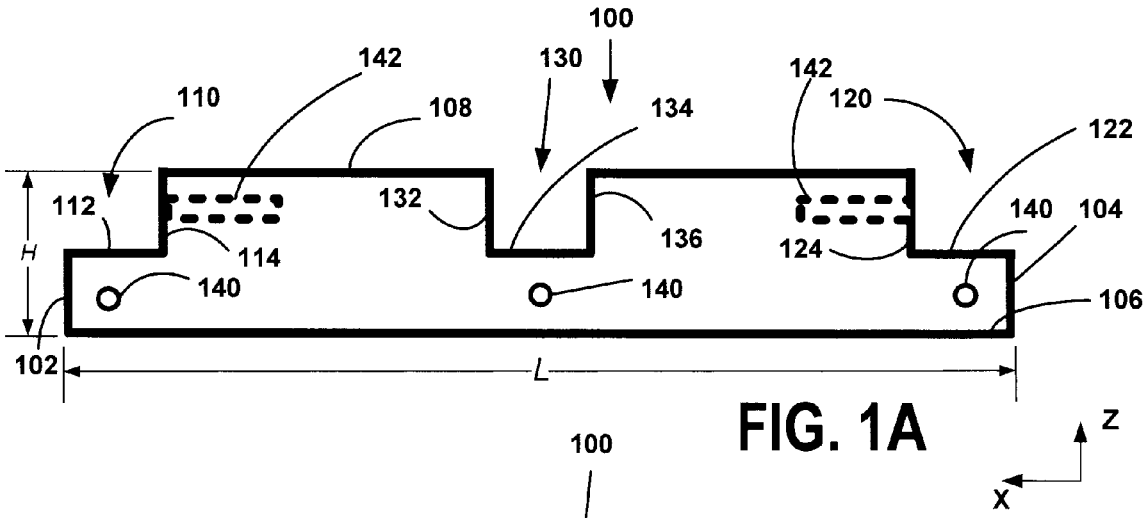
FIG. 1A illustrates a side view of a member of a lattice structure.

Embodiments described herein provide for a lattice structure, and components for making a lattice structure, which can be assembled with secure connections using primarily connection rods.

One or more embodiments described herein enable the creation of a lattice structure having individual members that are coupled using a combination of gapped or platformed connecting structures and connection rods. The gapped or platformed structures may be integrated or shaped sections of the members. The connecting members may extend into and/or through individual connecting members at the gapped or platformed structures of the connecting members. According to one or more embodiments, a resulting connection formed amongst the two connecting members is secure, while at the same time minimizing or eliminating the need for adhesives or connecting elements (e.g. clips) that are visible to detract from the appearance of the members.

With embodiments described herein, lattice structures may be created that can be made to any one of many possible designs. In one embodiment, the lattice structure may be created by an end-user or customer, from a kit or collection of members and connection rods. The connections amongst connecting members may be sufficiently simple to enable one of layman skill to create a lattice structure of a desired design. In one embodiment, the members and the connection rods are configured to enable assembly into a particular design without use of tools or supplemental connecting means amongst members. For example, the user may avoid use of hammers, measuring tools (to locate connection points), cutting equipment (to otherwise form shaped structures to interconnect members), or adhesives or clips. In this way, a user or a manufacturer is able to create an appealing lattice structure design that can have a style that is, for example, modern, for example, modern, traditional, Western, or Asian. Moreover, manufacturing costs may be reduced as compared to conventional lattice assembly techniques.

In one embodiment, connection amongst members includes inserting connection rods lengthwise into one of the connecting member and widthwise into another of the connecting members. Still further, one embodiment provides that the lattice structure is formed by a combination of connecting members that are coupled by overlapping the gapped or platformed connecting structure of one connecting member with the gapped or platformed connecting structure of another connecting member. When the two connecting members are overlapped, a connection rod is passed through or into a width thickness of one connecting member, and inserted into the other of the connecting members in a lengthwise direction.

In one embodiment, the resulting member connection is secure and quickly made. Moreover, under one or more embodiments, the resulting member connection can be achieved without the use of tools, and eliminates or reduces the need for ancillary connection means, such as adhesives.

As described herein, a lattice structure may comprise a combination of individual members that can be combined to form numerous different patterns and shapes. Among other uses, lattice structures may form wall structures from which plants may be grown or decorative items may be displayed. Typical applications for lattice structures include fences, gates, screens, and any other application where there is a need for a structural, light permeating surface that embeds pattern. Still further, other applications for lattice structures include tables, furniture, wall hangings, doors, and windows. According to embodiments described herein, lattice structures may be created that are two or three-dimensional.

In an embodiment, a lattice structure includes a plurality of members and a plurality of connection rods. The plurality of members may be individually oriented to form the lattice structure. Each of the plurality of members may include at least one of (i) an end section having a sidewall and a platform that define an end gap, or (ii) a mid-section having two sidewalls and a platform that define a mid-gap. Each member of the lattice structure may be connected to at least one other member, so that the lattice structure includes a plurality of connections between individual members in the plurality of members. Furthermore, each of at least some of the plurality of connections is formed by one of (i) an end section of a first member of that connection overlapping an end section of a second member of that connection; or (ii) an end section of the first member of that connection overlapping with a mid-section of the second member of that connection. The connections may further be formed by at least one connection rod that extends (i) lengthwise at least partially into the first member of that connection, and (ii) at least partially into the second member of that connection. This results in the connection rod maintaining the end section of the first member in overlapping the end section or mid-section of the second member.

Embodiments described herein provide for a collection of components that can or are assembled into a lattice structure. The collection may include a plurality of members and a plurality of connection rods. Each member includes one or more sidewalls and a platform that combine to form one of an end section or a mid-section. Each such end section or mid-section may define a gap. At least first member in the plurality of members includes a first aperture that extends into the sidewall of the end section of the first member. At least a second member in the plurality of members has a second aperture that extends at least partially in the end section or the mid-section of the second member. The end section of the first member is configured to overlap with the end section or mid-section of the second member. This results in first aperture of the first member being aligned with the second aperture of second member in order to receive one of the plurality of connection rods as securement for maintaining overlap of the end section of the first member and the end section or mid-section of the second member.

As used herein, the term "substantial" or "about" or other forms of the terms (e.g. "substantially") is intended to mean at least 90% of a stated relationship or quantity. In one embodiment, "substantial" or "substantially" means at or within a manufacturing tolerance.

Among other benefits, embodiments described herein provide for a lattice structure in which individual members are combined quickly and relatively securely. As a result, lattice structures of complex design or otherwise requiring numerous connections amongst individual members can be more readily made. In addition, one or more embodiments enable lattice structures to be assembled as from a kit or packaged product comprising members and connection rods.

Member Configuration

Figure 1B:
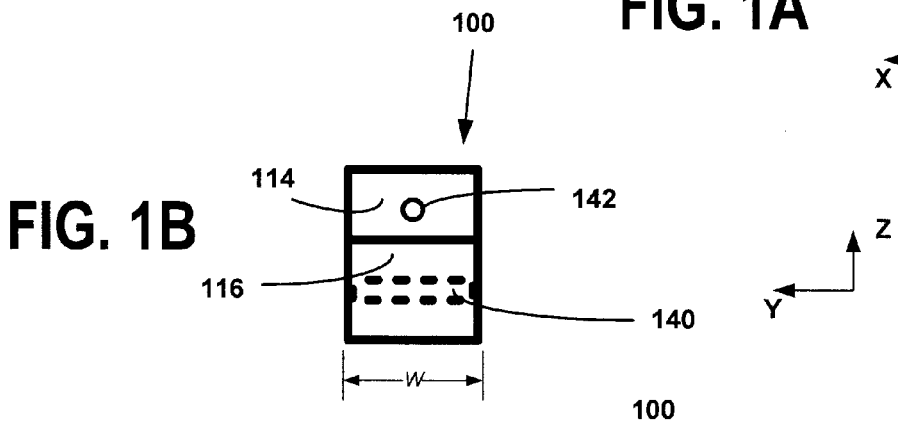
FIG. 1B illustrates an end face of the member of FIG. 1A.
Figure 1C:
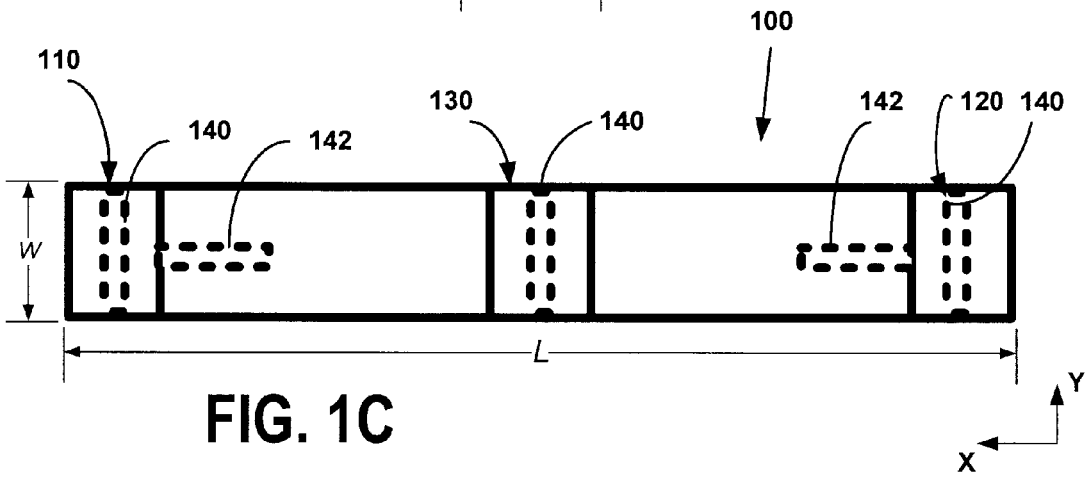
FIG. 1C illustrates a top view of the member of FIG. 1A.

FIG. 1A-FIG. 1C illustrate a member of a lattice structure, under an embodiment of the invention. FIG. 1A is a side view of a member 100. The member 100 has a length L extending from a first edge 102 to a second edge 104. The length L may reference an X direction. The member 100 also includes a continuous edge 106 (shown as a bottom edge in the orientation of FIG. 1A) and a non-continuous edge 108. A distance between the continuous edge 106 and the non-continuous edge 108 defines a height H or thickness of member 100. The direction of the height H may reference a Z direction.

For the particular implementation shown, the member 100 includes three gapped or platformed connecting structures. Each of the connecting structures are integrally or unitarily formed on the member. The connecting structures includes a first end structure 110 that extends from first edge 102 and includes an edge platform 112 and a sidewall 114. A second end structure 120 extends from second edge 104 and includes an edge platform 122 and a sidewall 124. A mid-structure 130 includes a first sidewall 132, a platform 134, and a second sidewall 136. As will be described, each connecting structure is dimensioned to overlap with a similarly shaped connecting structure of another member or members.

In an embodiment, member 100 includes platform apertures 140 positioned between the continuous edge 106 and each of the platforms 112, 122, and 134 of the corresponding connecting structures. Member 100 may also include a sidewall aperture 142 in the sidewall 114, 124 of each edge structure 110, 120. Each of the platform apertures 140 and the sidewall apertures 142 are dimensioned to receive a connection rod 190 (see FIG. 1D) in order to enable a secure connection with a connecting member. Depending on the implementation, the platform apertures 140 may either pass through the member or extend partially into the thickness of the member.

FIG. 1B is a side view of member 100 illustrating an end face 116 positioned below sidewall 114. A width W of the member 100 extends in a Y direction. In one embodiment, the platform aperture 140 passes through the end section 110, traversing the width W.

The member 100 may exemplify numerous other members that form a collection of members that can be used to form a lattice structure of a particular design. In one embodiment, a kit or package may be provided containing the collection of members. One package may contain multiple shapes, as shown and described with, for example, FIG. 6. Individual members may be formed from materials such as wood (including manufactured wood), metal, plastic, or ceramic. The members 100 may also be constructed to have alternative shapes. For example, as an alternative to rectangular or square cross-sections such as shown by FIG. 1A-FIG. 1C, elliptical or other polygonal cross-sectional shapes may be used.

FIG. 1C is a top view of member 100, showing the length L and width W of the member. As shown, an embodiment provides that each platform aperture 140 extends through the width W of the member, at a cross-section of one of the connecting structures. Each sidewall aperture 142 may extend partially into the member in the lengthwise direction (along X). In other embodiments, the platform aperture 140 may not necessarily extend through the width of member 100. For example, in some cases, the exposed dowel (resulting from the aperture extending through the thickness) may be unsightly or provide a rot point in the wood.

Figure 1D:
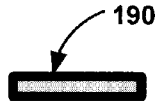
FIG. 1D illustrates a connection rod which may be inserted into apertures in lattice members under an embodiment of the invention.

A kit or package may also include connection rods for connecting one member to another member. The various member connections that can be formed between two members of the lattice are described below. FIG. 1D shows a connection rod 190 that may be used to at least partially connect two or more members together. The connection rod 190 may vary in length, cross-dimension and even shape, depending on design parameters. The connection rod 190 may also be formed from any one of many possible kinds of materials, or combinations of materials. In one embodiment, the connection rod 190 is formed from a rigid material that resists shearing. Examples of materials for the connection rod include wood, manufactured wood, metal (e.g., steel), plastic or a composite.

In a lattice structure, member 100 may be connected to other members, which may or may not have a similar dimension, configuration and/or number of connecting structures. As will be described, embodiments described herein provide for two members to connect using an end-to-end connection, an end-to-mid connection, or a mid-to-mid connection.

Member Connections

Figure 2A:
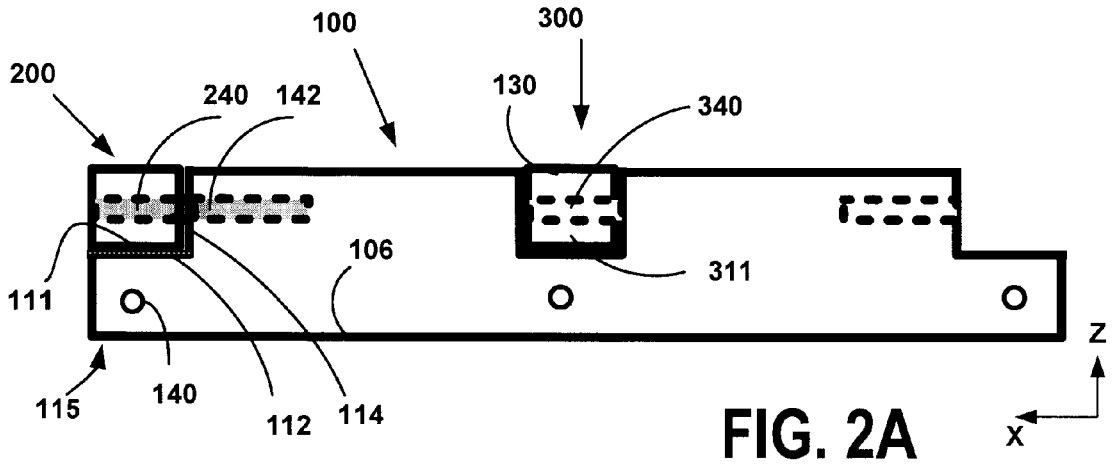
FIG. 2 illustrates a side view of a member connected to a second member and a third member.
FIG. 2B illustrates a side view of the member of FIG. 2A.
FIG. 2C illustrates an end-to-end connection using the member of FIG. 2A and another member.
Figure 2B:
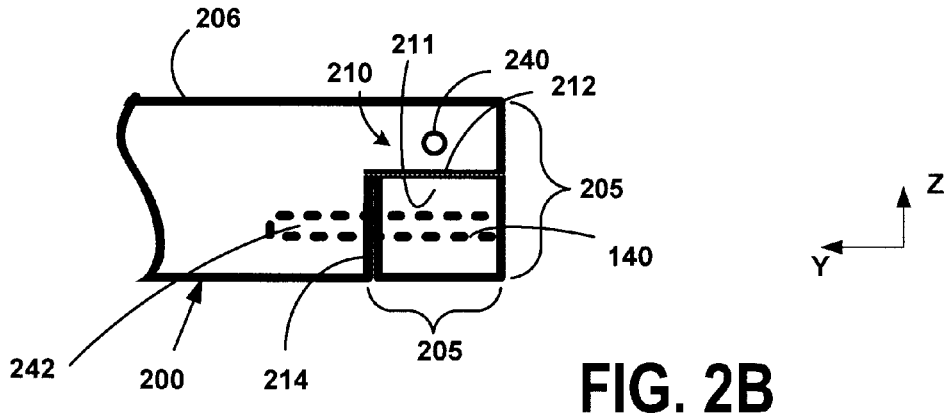
Figure 2C:
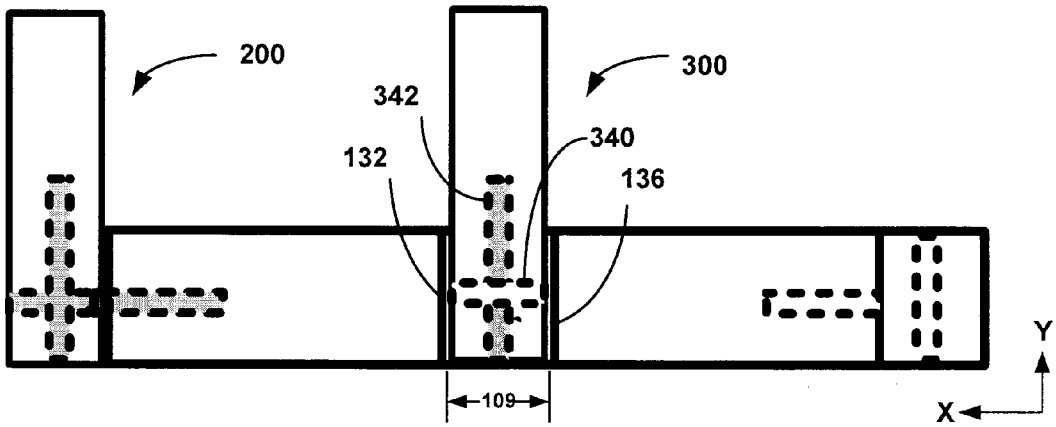

FIGS. 2A-2C illustrate member 100 connected to a second member 200 and a third member 300, in accordance with one or more embodiments of the invention. FIG. 2A is a side view of member 100 connected to member 200 and member 300. In an embodiment, the connections amongst members may be orthogonal. Thus, the lengthwise direction of connected members 200 and 300 is in the Y direction (into the paper in FIG. 2A). The widthwise direction of the connected members 200 and 300 is aligned with the lengthwise direction of member 100. Optionally, non-orthogonal or acutely angled connections may be implemented by, for example, angling the sidewalls.

FIG. 2B is a side view of FIG. 2A. With reference to FIG. 2A and FIG. 2B, the member 100 and the connected member 200 form an end-to-end connection 205, in which the end section 115 of member 100 overlaps with an end section 210 of member 200. As with member 100, the connected member 200 includes an end section 210 having a platform 212 and a sidewall 214. The connected member 200 includes a platform aperture 240 (extending widthwise between the platform 212 and a continuous edge of the member 200) and a sidewall aperture (not shown) for its end section 210. In one embodiment, the dimensions of the end section 210 of connected member 200 (including dimensions of the platform 212 and sidewalls of end section 210) may be substantially the same as the corresponding dimension of the end section 110 of member 100. Likewise, the relative position of the platform aperture 240 of connected member 200 relative to the end section 210 may be the same as that of the platform aperture 140 and sidewall aperture for the end sections 110, 120 of member 100.

In an implementation shown, however, the continuous edge 106 of member 100 is flipped relevant to a corresponding vertical edge of member 200. In such an orientation, an end gap 111 formed by platform 112 of section 110 in member 100 is occupied by a thickness of member 200, where the thickness is defined by the segment between a continuous edge 206 of the member and the platform 212. Likewise, a thickness of member 100 is provided by the segment between the continuous edge 106 and the platform 112. The thickness occupies an end gap 211 formed by platform 212 and sidewall 214. Thus, under one embodiment, the use of the thickness of each member 100, 200 to occupy the end gap 111, 211 formed over the platform 112, 212 of the other member 100, 200 provides the overlap.

As further shown by FIG. 2A and FIG. 2B, when the end section 110 of member 100 is overlapped with the end section 210 of the member 200, the sidewall aperture 142 of member 100 aligns with the platform aperture 240 of connected member 200. Likewise, the platform aperture 140 of member 100 aligns with the sidewall aperture 242 of the connected member 200. In the end-to-end connection shown by FIG. 2A and FIG. 2B, connection rod 190 (FIG. 1D) may be passed through the platform aperture 140 of member 100 and the sidewall aperture 242 of connected member 200. Another connection rod 190 (FIG. 1 D) may be passed through the sidewall aperture 142 of member 100 and the platform aperture 240 of member 200. The result is the end-to-end connection 205 includes (i) one connection rod 190 extending through thickness of connected member 200 and into the member 100 in the lengthwise direction, and (ii) another connection rod 190 extending through thickness of member 100 and into the connected member 200 in the lengthwise direction. The combination of rods 190 in the overlap of the end-to-end connection preludes, or at lease inhibits, movement of either member 100, 200 in any of the X, Y or Z directions.

With further reference to FIG. 2A and FIG. 2C, an end-to-mid connection is shown formed between member 100 and connected member 300. For simplicity, member 300 is assumed to be duplicate in construction (including shape and dimension) as member 100. In the end-to-mid connection, an end section (not shown) of connected member 300 is overlapped with the mid-section 130 of the member 100. The end section of connected member 300 may be represented by the end face 311, which is received in a mid-gap 109 defined by the platform of the mid-section 130. In one implementation, the connected member 300 is held relatively flush against the facade of the member 100. The aperture 140 of mid-section 130 may align with a sidewall aperture 342 of the member 300 so that the connection rod passes widthwise through the member 100 and is axially (i.e. lengthwise) retained within the connected member 300. The connected member 300 may include a platform aperture 340 that is unused when its end section is overlapped with a mid-section.

The connection rod 190 extending from member 100 to the connected member 300 may be used to preclude or hinder movement that would separate the connected member in the Z direction (out of the paper). The sidewalls 132, 136 may preclude movement in either direction along axis X. Likewise, the overlap formed by the member 100 and connected member 300 may preclude movement in one Z direction (into paper) and one Y direction (downward in paper). But movement in the other Y direction may not be secured, relative to the other directions. In contrast, FIG. 1C illustrates that the end-to-end connection precludes movement in all six directions.

Figure 3A:
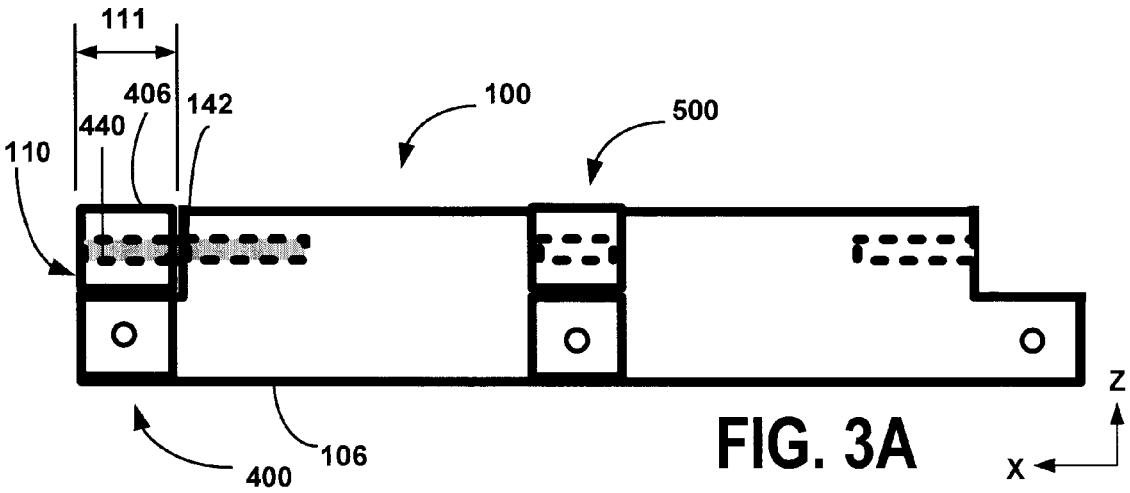
FIG. 3A illustrates a side view of a member connected to a fourth member and a fifth member.
Figure 3B:
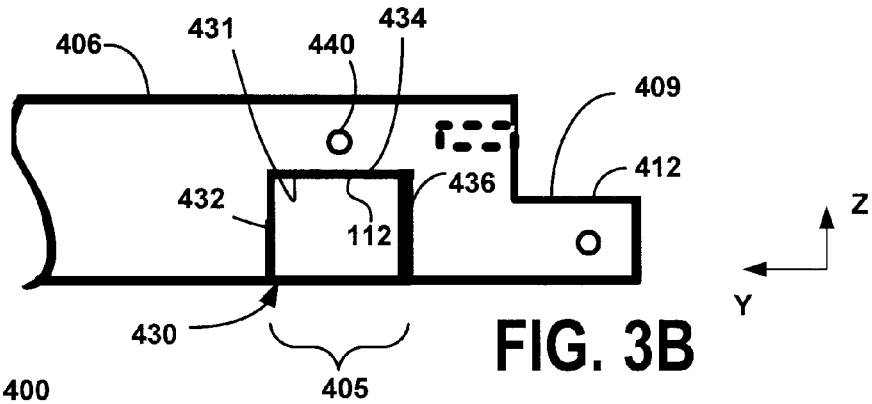
FIG. 3B illustrates a side view of the member of FIG. 3A.
Figure 3C:
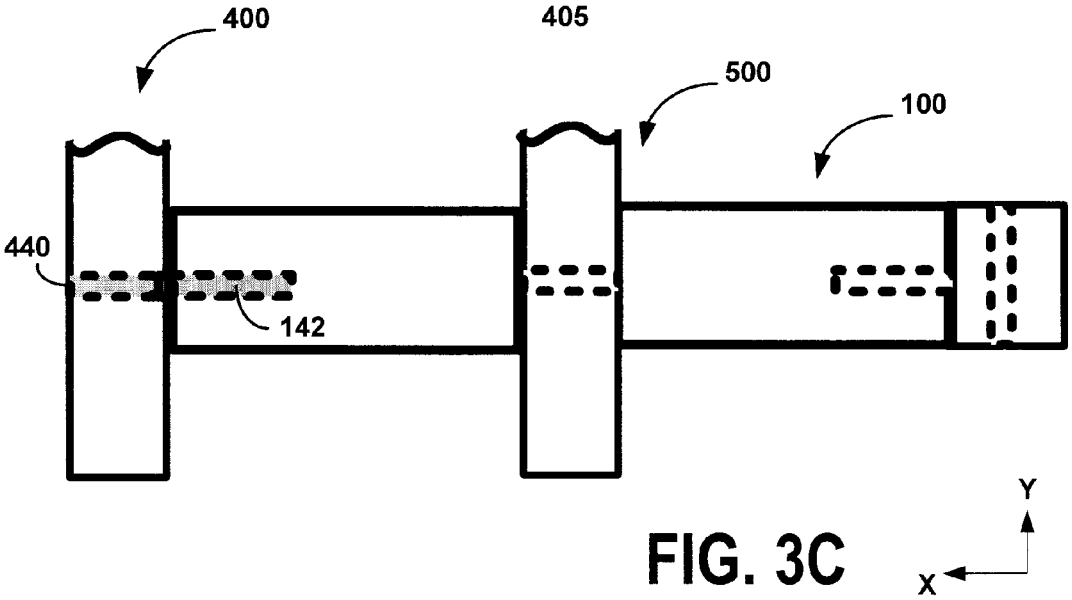
FIG. 3C illustrates a mid-to-mid connection using the member of FIG. 3A and another member.

FIGS. 3A-3C illustrate member 100 connected to a fourth member 400 and a fifth member 500, in accordance with one or more embodiments of the invention. FIG. 3A is a side view of member 100 connected to member 400 and member 500. In an embodiment, the connections amongst members are orthogonal. Thus, the lengthwise direction of connected members 400 and 500 is in the Y direction. The widthwise direction of the connected members 400 and 500 is aligned with the lengthwise direction of member 100.

With reference to FIG. 3A and FIG. 3B, the member 100 and the connected member 400 form an end-to-mid connection 405, in which the end section 110 of member 100 overlaps with a mid-section 430 of member 400. In an embodiment, the end-to-mid connection 405 may be similar to that of FIG. 2C, between first member 100 and third member 300. Moreover, for simplicity, member 400 (or at least the pertinent portion being discussed) may be substantially similar to the construction of member 100. As such, connected member 400 includes a continuous edge 406 that is opposite the continuous edge 106 of the member 100.

FIG. 3B is a side view of FIG. 3A. With reference to FIG. 3A and FIG. 3B, connected member 400 is shown with end face 411 and platform 412, defining an end gap 409. The platform 412 may be unused in the connection formed with the first member 100. Rather, a mid-section 430 of member 400 may overlap with end section 110. Mid-section 430 includes sidewalls 432, platform 434, and sidewall 436, defining a mid-gap 431. The mid-section 430 is dimensioned so that it fits over the end gap 111 provided at end section 110, with the platform 434 abutting the platform 112 of member 100. Thus, the mid-gap 431 provides a void that receives a correspondingly dimensioned thickness of member 100. The mid-section 430 may be dimensioned to accommodate the width W of the end section 110 of member 100.

As the connected member 400 is similar in construction to member 100, the connected member 400 includes a platform aperture 440 positioned between the continuous surface 406 and the platform 434 of the mid-section 430. As shown by FIG. 3C, the platform aperture 440 aligns with the sidewall aperture 142 of member 100 when the mid-section 430 of connected member 400 overlaps with the end section 110 of member 100. The connecting member 190 (FIG. 1D) may be inserted into the connecting aperture of the fourth member 400 and the sidewall aperture 142 of the member 100 to form a secure connection. However, as with the connection formed between the member 100 and the third member 300, not all possible directions are as securely fixed with the connection formed between member 100 and member 400. In particular, leftward movement along the axis X is relatively unsecured.

With reference to FIG. 3A and FIG. 3C, a mid-to-mid connection is shown between first member 100 and fifth member 500, under an embodiment of the invention. In an embodiment, a mid-to-mid connection does not enable use of connection rods, as only the vertical (Z direction) in FIG. 3C enables the connection rod to be inserted into both members after the two members have been placed in overlap. For this reason, one or more embodiments provide that mid-to-mid connections are interior formations that leverage securements from exterior end-to-end connections.

Figure 4:
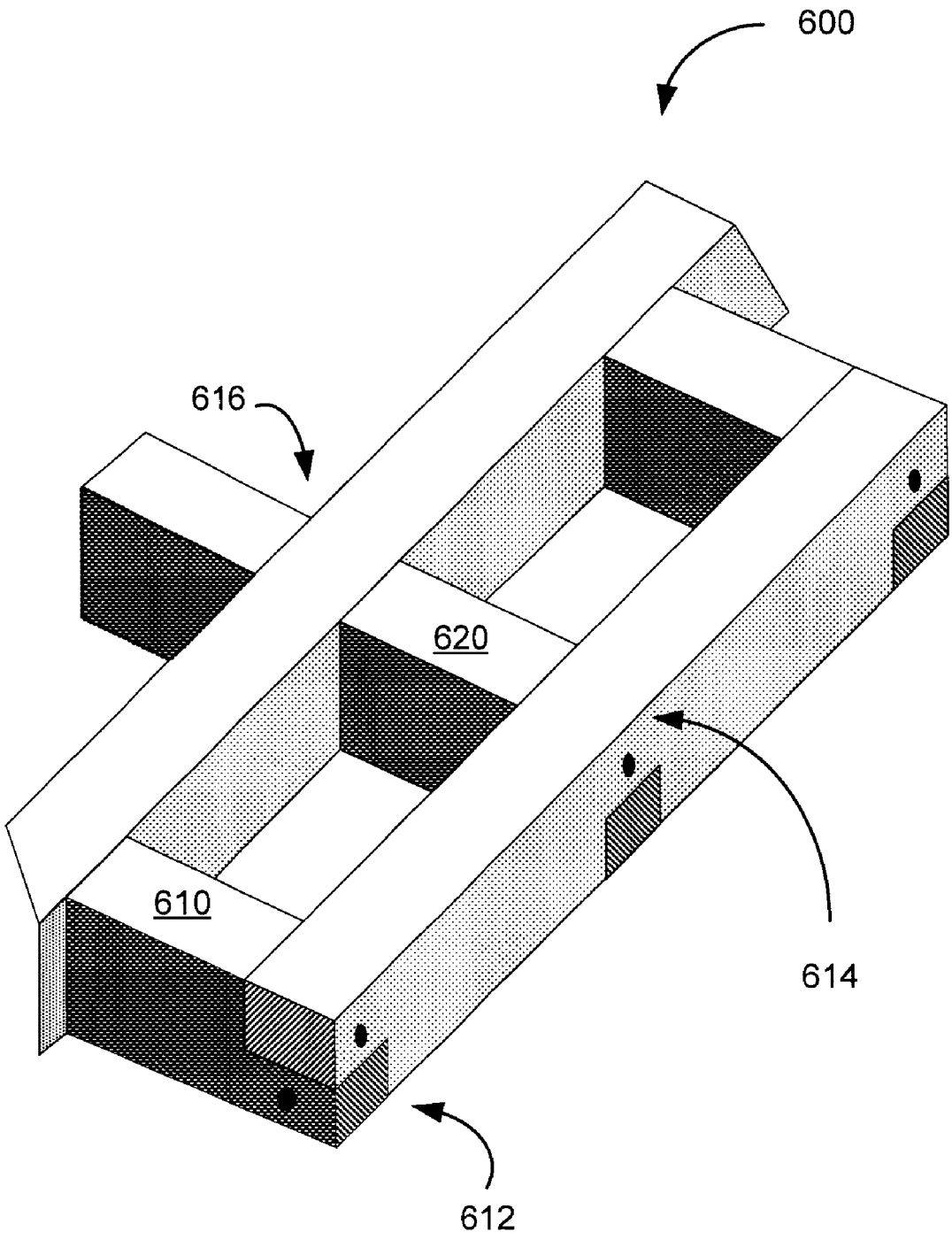
FIG. 4 illustrates a lattice structure formed from a combination of members and member connections, such as provided with embodiments provided herein.

FIG. 4 illustrates a lattice structure formed from a combination of members and member connections, such as provided with embodiments provided herein. In particular, a lattice structure 600 includes multiple criss-crossing members 610, 620 connected by one of an end-to-end connection 612, end-to-mid connection 614, or mid-to-mid connection. The end-to-end connections 612 secure connecting members in all six possible directions of movements. For this reason, an embodiment provides that the lattice structure 600 includes four or more end-to-end connection 612. Furthermore, as noted previously, the mid-to-mid connection 616 lacks use of connecting member 190 (at least in widthwise and/or lengthwise orientation). For this reason, the mid-to-mid connection 616 may require other forms of securement (e.g. glue) or its use in a configuration that leverages other end-to-end connections 612.

Figure 5A:
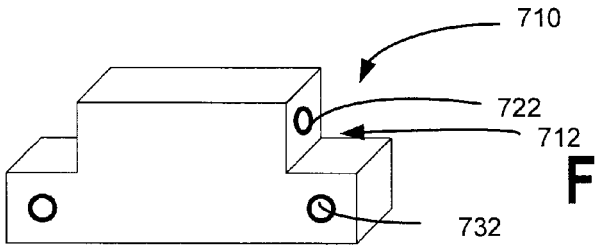
FIG. 5A illustrates a member including only end sections.
Figure 5B:
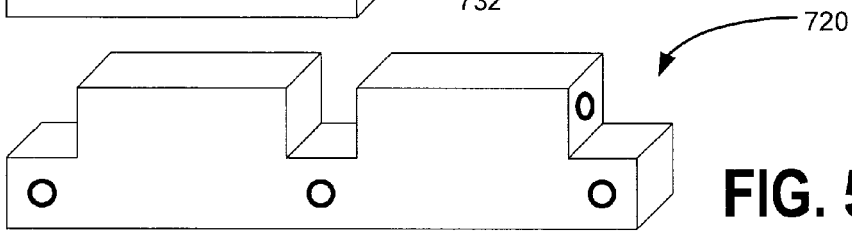
FIG. 5B illustrates a member similar to the member of FIG. 1A.
Figure 5C:
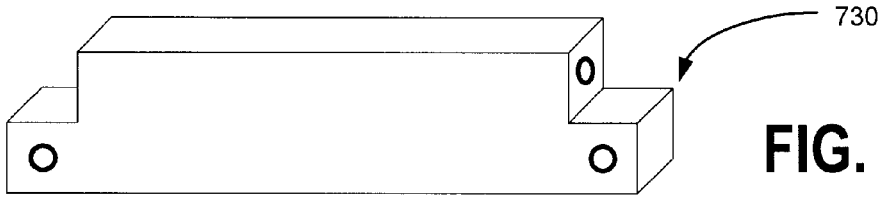
FIG. 5C illustrates an elongated member similar to the member of FIG. 5A.
Figure 5D:
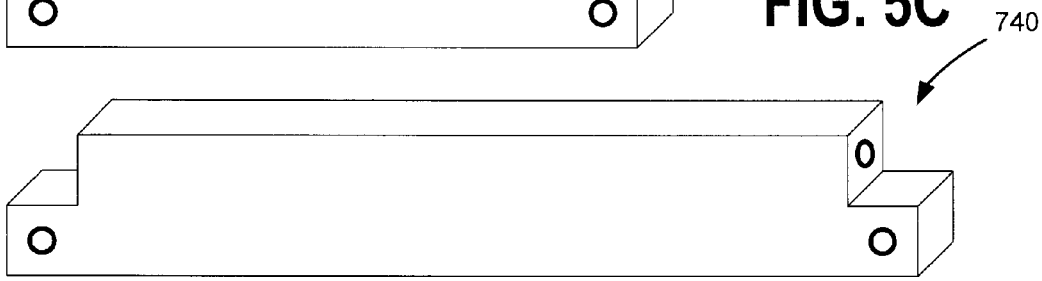
FIG. 5D illustrates another elongated member similar to the member of FIG. 5A.
Figure 5E:
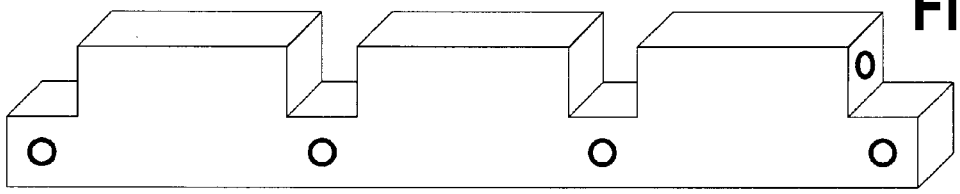
FIG. 5E illustrates an elongated member similar to the member of FIG. 5A with an additional mid-section.
Figure 5F:
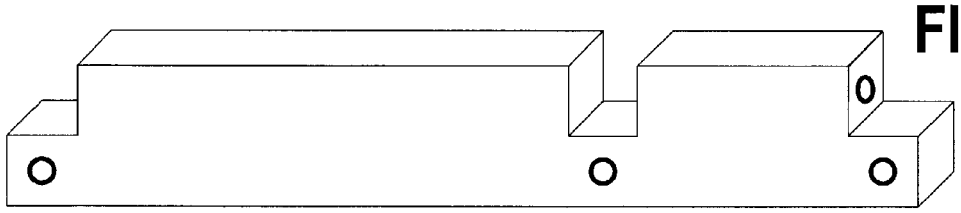
FIG. 5F illustrates an elongated member with a mid-section that is asymmetrically positioned between opposite ends.

FIGS. 5A-5F illustrate various members for use in constructing a lattice structure, under an embodiment of the invention. In FIG. 5A, a member 710 includes only end sections 712. As described with other embodiments, the end section 712 includes the platform aperture 722 and sidewall aperture 732 for receiving the connection rods. FIG. 5B illustrates a member 720 which is similar to member 100 of FIG. 1A-FIG. 1C. A member 730 of FIG. 5C and a member 740 of FIG. 5D may correspond to an elongated version of member 710. A member 750 of FIG. 5E is elongated version of member 710, with an additional mid-section. FIG. 5F illustrates an elongated member 760 with a mid-section that is asymmetrically positioned between opposite ends.

FIGS. 6A thru 6K illustrate various different lattice structures that can be assembled using embodiments such as described in this application. In one embodiment, a lattice structure incorporating any of the arrangements shown in FIGS. 6A-6K (or other lattice structure arrangements not explicitly shown) may be manufactured into desired structures.

In another embodiment, a kit or package for assembling a lattice structure may be provided to consumers as a "do-it-yourself" kit. In such an embodiment, members may be manufactured and shipped with pre-formed platform apertures, sidewall apertures and end/mid-sections such as shown and described. Any member may be combined with other members using one of the end-to-end, mid-to-end, or mid-to-mid connections such as described herein.

As illustrated by the lattice structures illustrated with FIGS. 6A-6K, one or more embodiments recognize the use of end-to-end connections to form perimeter corners 802 of the overall lattice structure. The end-to-end connections preclude or hinder movement amongst two connected members in all six directions. As such, the use of at least four perimeter corners 802 enables the creation of a stable lattice structure.

Furthermore, the use of interior comers 804 that include end-to-end connections stabilize interior structures that may be elaborate. Embodiments recognize that isolated mid-to-end connections in and of themselves may lack support to maintain an overlap or connections amongst two members in at least one direction For example, with reference to FIG. 6A, mid-to-end connection 806 may lack support in the Y-direction. But the mid-connection is positioned in the lattice structure to have support in the X-direction, where it is coupled to the exterior comer 802. Support in the Y-direction may thus translate from the exterior connection 802 to the mid-connection 806.

Figure 6A:
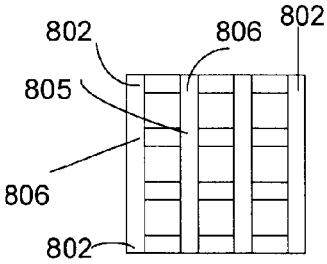
FIG. 6A illustrates a lattice structure with four perimeter comer connections and multiple mid-to-end connections.
Figure 6B:
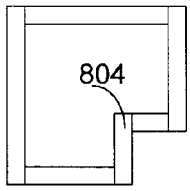
FIG. 6B illustrates a lattice structure with an interior comer.
Figure 6C:
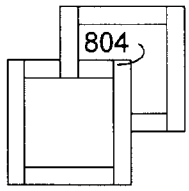
FIG. 6C illustrates another lattice structure with an interior comer.
Figure 6D:
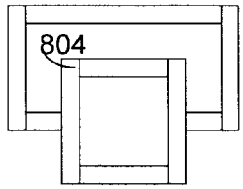
FIG. 6D illustrates a lattice structure with multiple interior comers.
Figure 6E:
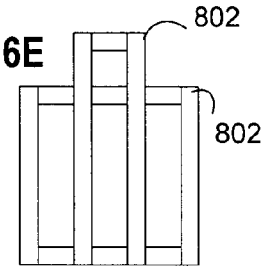
FIG. 6E illustrates a lattice structure.
Figure 6F:
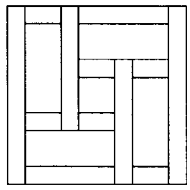
FIG. 6F illustrates another lattice structure.
Figure 6G:
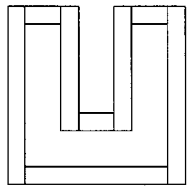
FIG. 6G illustrates another lattice structure under one embodiment.
Figure 6H:
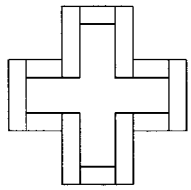
FIG. 6H illustrates another lattice structure.
Figure 6H:
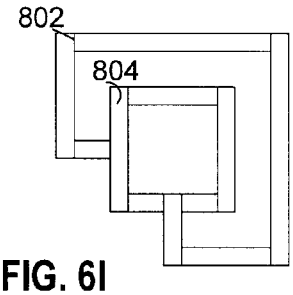
Figure 6I:
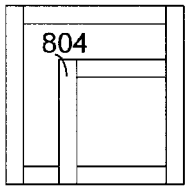
FIG. 6I illustrates a lattice structure with multiple perimeter corner connections and multiple interior comers.
Figure 6J:
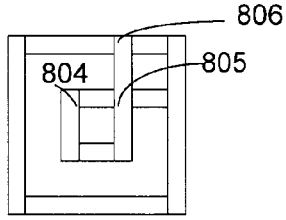
FIG. 6J illustrates another lattice structure with an interior comer.
Figure 6K:
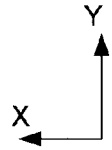
FIG. 6K illustrates a lattice structure with an interior portion supported by three interior comers and one mid-to-mid connection.

Likewise, embodiments recognize that isolated mid-to-mid connections in and of themselves lack support to maintain an overlap or connection amongst two members in at least two directions. For this reason, the assembly may be designed to support mid-to-end and mid-to-mid connections with counter-directed connections. For example, with reference to FIG. 6A, the mid-to-mid connection 805 is supported by adjacent mid-to-end connections 806 (up and left), as well as proximate exterior comer connection 802. The other mid-to-end connections (in other three remaining directions) further support the mid-to-mid connection 805. With reference to FIG. 6K, an interior portion of the lattice structure is supported by three interior comers 804, and one mid-to-mid connection 805. The mid-to-mid connection is further supported by a mid-to-end connection 806 and an exterior comer 802.

Alternative Embodiments

While embodiments described herein provide for the connection rod to pass completely through a width of one connecting member and insert axially in another of the connecting members, one or more embodiments provide for a configuration in which the connection rod only partially passed widthwise through the thickness. For example, in an end-to-end connection, the connection rod 190 may first be inserted longitudinally into one connecting member, then the other connecting member may be directed into the connection rod through use of an appropriately positioned platform aperture. In such an embodiment, the platform aperture may be positioned on one side of a connecting member, and not the other.

Figure 7A:
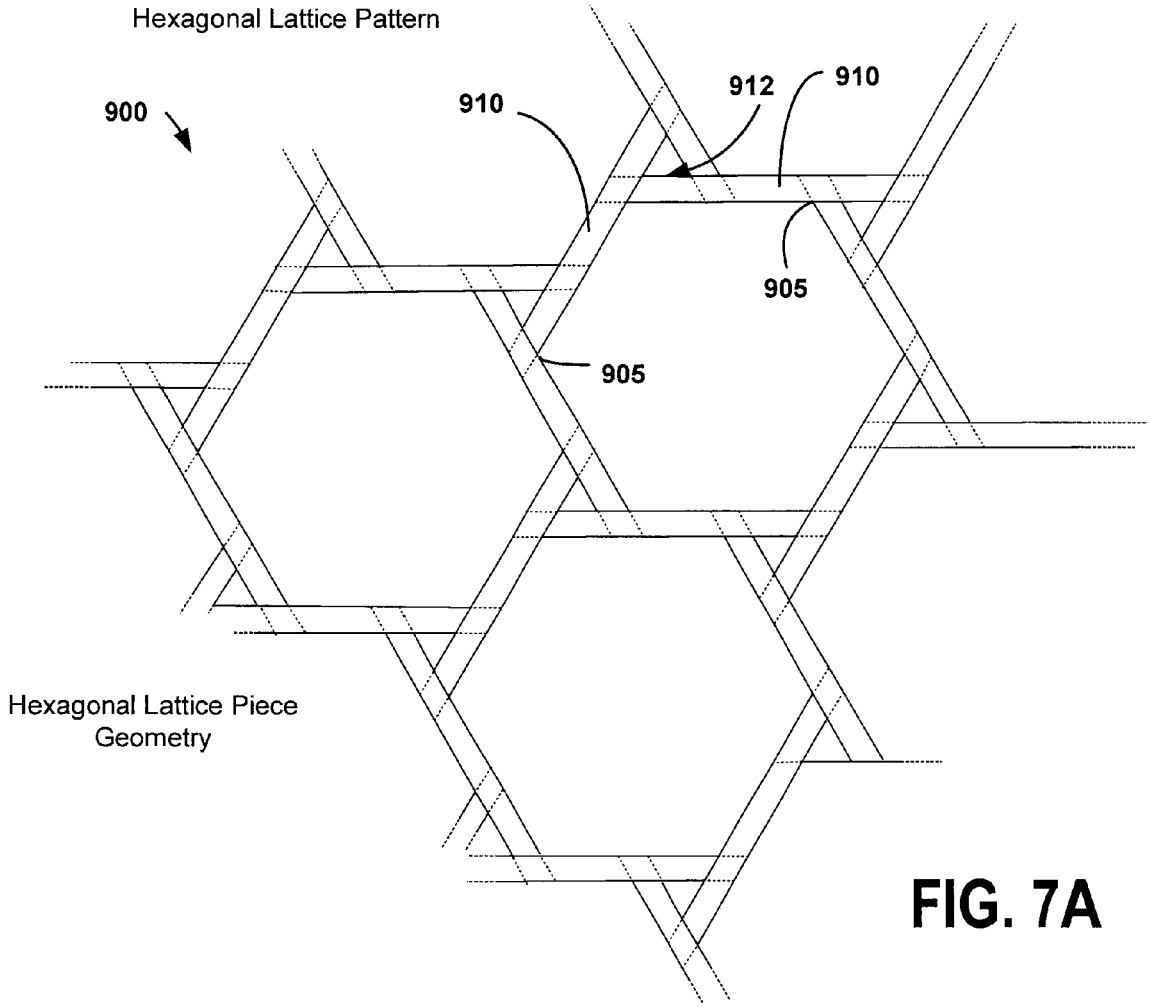
FIG. 7A illustrates an embodiment in which a lattice structure is formed by connecting members that align at acute angles with one another.

Still further, while numerous embodiments described above provide for members of the lattice structure to align orthogonally or at right-angles with one another, other embodiments contemplate use of acute angles between connecting members. FIG. 7A illustrates an embodiment in which a lattice structure 900 is formed by connecting members 910 that align at acute or obtuse angles 905 with one another. In one implementation, for example, connecting members may connect at an angle of 60 degrees. Such acute/obtuse angle formations may be provided by, for example, incorporating specialty pieces in an overall assembly, although entire structures comprising acutely/obtusely angled connecting members may also be accomplished. The use of acute/obtuse angles 905 may result in formation of triangles 912 and non-rectangular polygons. Still further, in one embodiment, use of acute/obtuse angles may be achieved by shaping individual side walls at acute/obtuse angles as they extend vertically from a corresponding platform.

Figure 7B:
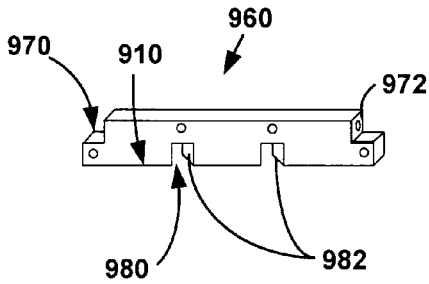
FIG. 7B illustrates a member for use in creating a lattice structure such as shown and described with an embodiment of FIG. 7A.

FIG. 7B illustrates a member 960 for use in creating a lattice structure such as shown and described with an embodiment of FIG. 7A. In particular, member 960 may include platforms at a mid-section 980 and an end-section 970 that have acutely/obtusely angled sidewalls 982,972 respectively. The acutely/obtusely angled sidewalls enable the member 960 to receive other members at the acute/obtuse angle defined by the respective sidewalls.

CONCLUSION

Although the descriptions above contain many specifics, these should not be construed as limiting the scope of the invention but as merely providing illustrations of some embodiments.

The invention claimed is:

1. A lattice structure comprising:

a plurality of members, the plurality of members being individually oriented to form the lattice structure, wherein each of the plurality of members includes at least an end section having a sidewall that extends in a first direction to form an edge with a platform, the platform extending at least in part along a second direction orthogonal to the first direction; and a plurality of connection rods;

wherein each member of the lattice structure is connected to at least one other member of the lattice structure, so that the lattice structure includes a plurality of connections between individual members of the plurality of members, and wherein each of at least some of the plurality of connections is formed by the end section of a first member of the plurality of members overlapping the end section of a second member of the plurality of members, and;

wherein each of the connections formed by the end section of the first member overlapping the end section of the second member is further formed by at least a first connection rod and a second connection rod of the plurality of connection rods, the first connection rod extending widthwise through the second member and lengthwise into the sidewall of the first member, wherein the first connection rod is not extended through the platform of the first member while engaged with both the first and second members, and the second connection rod extending widthwise through the first member and lengthwise into the sidewall of the second member, so as to maintain the connection between the first member and the second member.

2. The lattice structure of claim 1, wherein two or more members of the plurality of members form at least one of the plurality of connections by overlapping a mid-section of a member of the two or more members with a mid-section of another member of the two or more members.

3. The lattice structure of claim 2, wherein the at least one of the plurality of connections formed by the two or more members is formed without a connection rod extending within the two or more members.

4. The lattice structure of claim 1, wherein two or more members of the plurality of members form at least one of the plurality of connections by overlapping an end section of a member of the two or more members with mid-section of another member of the two or more members.

5. The lattice structure of claim 1, wherein the first connection rod extends widthwise completely through the second member and the second connection rod extends widthwise completely through the second member.

6. The lattice structure of claim 1, wherein the lattice structure includes a plurality of perimeter corners, wherein each perimeter corner is formed by the end section of one of the plurality of members overlapping the end section of another of the plurality of members.

7. The lattice structure of claim 1, wherein an angle formed by the first member and the second member of each of one or more of the plurality of connections is 90 degrees.

8. The lattice structure of claim 1, wherein an angle formed by the first member and the second member of each of one or more of the plurality of connections is acute.

* * * * *